United States Patent [19]

Bakermans

[11] 4,077,695

[45] Mar. 7, 1978

[54] TERMINATION MEANS FOR RIBBON CABLES

[75] Inventor: Johannes Cornelis Wilhelmus Bakermans, Harrisburg, Pa.

[73] Assignee: AMP Incorporated, Harrisburg, Pa.

[21] Appl. No.: 749,656

[22] Filed: Dec. 10, 1976

Related U.S. Application Data

[63] Continuation-in-part of Ser. No. 666,552, Mar. 15, 1976, Pat. No. 4,005,518.

[51] Int. Cl.[2] ..... H01R 9/08; H01R 43/04

[52] U.S. Cl. ..... 339/176 MF; 29/628; 29/749; 29/760; 339/99 R

[58] Field of Search ..... 29/749, 759, 760, 751, 29/752, 628; 339/99 R, 176 M, 176 MF, 17 F

[56] References Cited

U.S. PATENT DOCUMENTS

| | | | |
|---|---|---|---|
| 3,768,067 | 10/1973 | Rault | 339/99 R |
| 3,816,818 | 6/1974 | Meier | 339/99 R |
| 3,930,708 | 1/1976 | Wedekind et al. | 339/99 R |

*Primary Examiner*—Carl E. Hall

*Attorney, Agent, or Firm*—Frederick W. Raring; Robert W. Pitts; Jay L. Seitchik

[57] ABSTRACT

Conductor positioning means intended for use with flat multi-conductor cable comprises a pair of opposed surfaces between which the cable is clamped. Each surface has parallel side-by-side flutes extending thereacross which are spaced-apart on center lines by an amount equal to the nominal spacing between adjacent conductors in the cable. Each flute has a center of curvature and a radius of curvature and the centers of curvature of alternate flutes on each surface are offset with respect to the centers of curvature of the remaining flutes on the surface. The geometry of the flutes in the two surfaces is the same but the offset flutes of one surface are opposed to flutes which are not offset in the other surface so that when the two surfaces are against each other, the centers of the openings formed by the flutes define a zig-zag pattern as viewed in cross section. When a section of cable is positioned between the two surfaces and the surfaces are moved towards each other and into clamping engagement with the cable, the conductors in the cable are displaced laterally, in the plane of the cable, by the opposed surfaces of the flutes until the conductors are precisely located on the center lines of the flutes.

9 Claims, 13 Drawing Figures

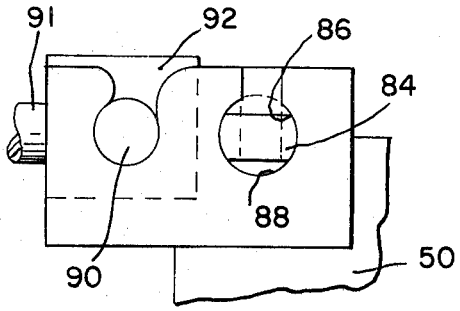
FIG. 7
FIG. 8
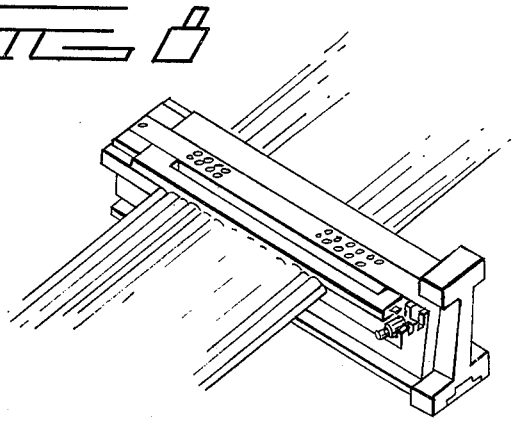
FIG. 9
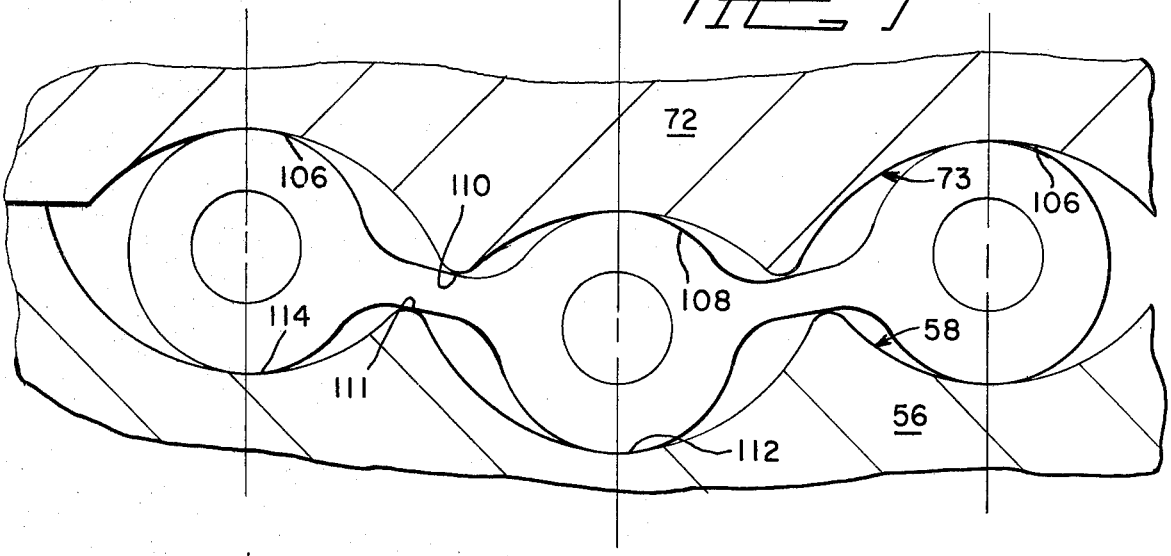
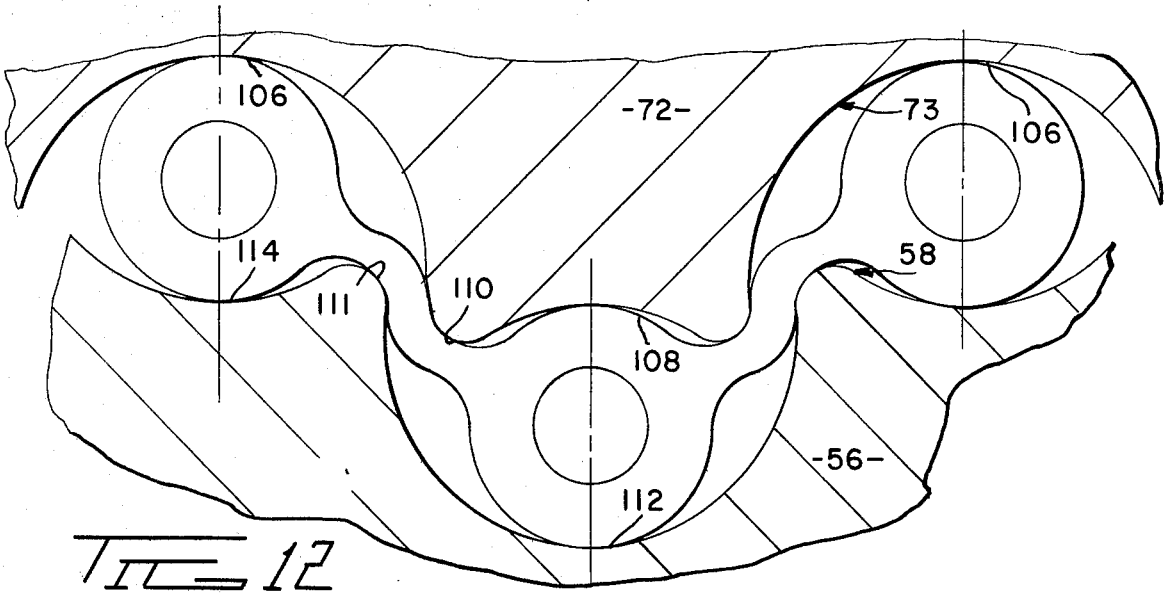
FIG. 12

TERMINATION MEANS FOR RIBBON CABLES

BACKGROUND OF THE INVENTION

This application is a continuation-in-part of application Ser. No. 666,552 filed Mar. 15, 1976, now U.S. Pat. No. 4,005,518.

This invention relates to a means for positioning the conductors of a ribbon cable at precise spaced-apart locations relative to each other in preparation for installation on the cable of a multi-contact connector. The invention is described in detail below in conjunction with a fixture as disclosed and claimed in U.S. Pat No. 4,005,518 however, the principles of the invention can be used under a variety of circumstances as is also explained briefly below.

Flat electrical cables of the type comprising a plurality of spaced-apart conductors contained in insulating material are now widely used in many segments of the electrical industry. Electrical connections to the conductors of the cable can be made by means of an electrical connector comprising a housing having a cable receiving surface from which a number of electrical terminals extend, the number of terminals being equal to the number of conductors in the cable. When the cable is moved against the cable receiving surface, the terminals penetrate the insulation of the cable and establish electrical contact with the conductors. Connectors of this general type are shown, for example, in U.S. Pats. 3,189,863 and 3,820,055.

The above identified U.S. Pat. No. 4,005,518 discloses and claims a fixture for clamping a flat electrical cable and holding it adjacent to the electrical terminals of a multi-contact electrical connector of a general type disclosed in the above identified U.S. Pat. Nos. 3,189,863 and 3,820,055. The fixture disclosed in my U.S. Pat. No. 4,005,518 has proved to be highly successful however, problems are encountered when the conductors of the cable to which the connector is being applied are not spaced-apart by reasonably uniform distances. In fact, most of the problems which have been encountered in the use of the fixture disclosed in the above identified application have stemmed from the fact that the conductors of the cable were not precisely located relative to each other so that when the cable is moved towards the terminals, some of the conductors may not be in alignment with the terminals in the connector and they will not, therefore, enter the wire-receiving slots in the connector. This problem is vexatious for the reason that it is virtually impossible to ensure that the conductors in the cable will always be spaced-apart by the nominal distance d and will lie within a predetermined tolerance range, i.e. $d \pm t$ where $t$ is the tolerance range of the spacing between conductors. A flat cable may be manufactured so that the conductors are in fact precisely located at the time of manufacture but the precise spacing between conductors can be lost as a result of many different causes; for example, the technician installing the connectors on the cable might unconsciously twist the cable or handle it in a way which would move the conductors apart and beyond their manufacturing tolerance specifications. Also, the relatively soft insulation of the flat cable which holds the connectors in spaced-apart relationship tends to flow or become distorted under some circumstances such as when a strip is imposed on the cable and this distortion destroys the accuracy of the spacing of the conductors. To summarize, the spacing between adjacent conductors in a flat conductor cable is so easily changed by any one of these factors that it is impossible or at least impractical to assume that the cable to which a connector is being applied will lie within the tolerance limits of the manufacturer's specifications.

In accordance with the principles of the instant invention, the conductors in that portion of the cable on which the connector is being installed are repositioned, when necessary, immediately prior to their being moved into the wire-receiving slots of the terminals in the connector. This repositioning or "reworking" of the cable is accomplished, in accordance with one embodiment of the invention, by clamping the cable between opposed surfaces which have flutes therein, the centers of the flutes being spaced-apart by a distance d which is the same as the center-to-center spacing d of the conductors of the cable. The flutes have offset radii of curvature and when the surfaces of the flutes move against the conductors of the cable they move any conductors which are not properly located laterally for a short distance until the desired center-to-center spacing is achieved. Portions of the conductors which are immediately adjacent to the section of the cable which is clamped in the fluted surfaces are also displaced laterally until they are precisely located on the desired center lines. The connector can then be installed on this adjacent section of the cable and the conductors of the cable will move into the wire-receiving slots of the terminals.

It is accordingly an object of the invention to provide a means for precisely locating the conductors of a flat cable on predetermined center lines. A further object is to provide a means for repositioning the conductors of a flat cable so that the conductors are spaced-apart by a precisely predetermined distance. A further object is to provide an improved apparatus for installing a multi-contact connector on a flat multi-conductor cable, the apparatus having means for repositioning the conductors, if necessary, so that they will be in alignment with the terminals in the connector. A further object is to provide an improved multi-contact electrical connector for a flat cable which incorporates therein means for precisely locating the conductors in the cable in alignment with the terminals in the connector.

These and other objects of the invention are achieved in preferred embodiments thereof which are briefly described in the foregoing abstract, which are described in detail below, and which are shown in the accompanying drawing in which:

FIG. 7 is a fragmentary end view of a portion of the fixture illustrating details of a latching arrangement for latching the clamping bar in its closed position.

FIG. 8 is a perspective view illustrating the manner in which a connector is installed on an intermediate portion of the cable.

FIG. 9 is a cross sectional view on an enlarged scale of the opposed surfaces of the cable supporting surface on the flange 56 and the opposed surface of the clamping bar 72 illustrating the geometry of the flutes on these surfaces which serve to properly locate the conductors of the cable.

FIG. 12 is a view similiar to FIG. 9 but showing an alternative embodiment.

Figure 1:
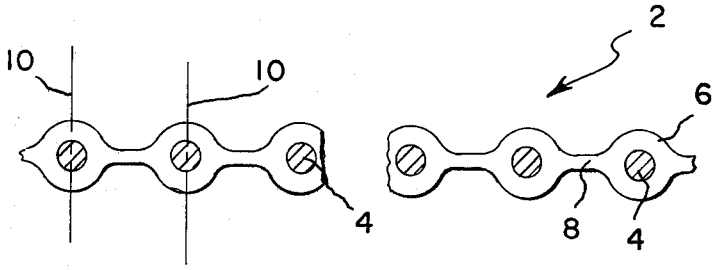
FIG. 1 is a perspective view of a short section of a typical flat conductor cable of the type commonly referred to as ribbon cable.

A widely used type of flat conductor cable 2, FIG. 1, comprises a plurality of parallel spaced-apart conductors 4, each of which is contained in an insulating sheath 6. The adjacent conductors are joined to each other by insulating material 8 which extends between the insulation 6 provided on the adjacent conductors. A variety of specific types of ribbon cables are available. For example, the cable 2 can be manufactured by a continuous extrusion process so that the insulating material 6 which surrounds the conductors 4 and the web material 8 are continuous and homogenous. Another type of cable comprises separate insulated wires 4, 6 and the wires are held in spaced-apart parallel relationship by sheets of film bonded to the insulation of the conductors and extending between adjacent conductors. A further type of flat cable comprises two sheets of film which are bonded to and against each other with the conductors contained between the sheets of film. It will be understood that the principles of the invention can be used to advantage for all of these types of flat cable.

The conductors 4 are spaced-apart by uniform nominal distances between their center lines 10 and there are manufacturing tolerances within which the center lines would lie. For example, where the nominal spacing between adjacent conductors is 0.050 inches, the tolerance limits are frequently ± 0.003 inches. As will be explained below, a given section of ribbon cable may have its conductors spaced-apart by an amount which is greater than or less than the extreme tolerance limits set by the cable manufacturer as a result of normal handling of the film after manufacture. The instant invention is directed to the problem of installing a connector on a cable 2 where the spacing between adjacent conductors 4 is non-uniform and/or is beyond the tolerance limits which are normally expected.

Figure 2:
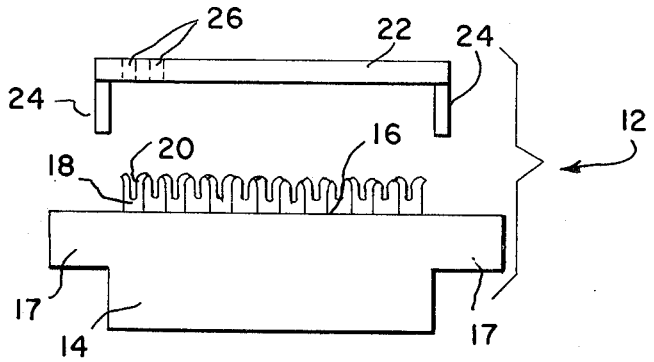
FIG. 2 is a frontal view of a type of multi-contact connector which is used with the cable shown in FIG. 1.

FIG. 2 shows a connector 12 of the general class more specifically disclosed in the above identified U.S. Pat. Nos. 3,189,863 and 3,820,005. Connectors of this type comprise an insulating housing 14 having a cable receiving surface 16 and having laterally extending ears 17 at its ends. A plurality of electrical contact terminals are contained in the housing and each terminal has a wire-receiving portion 18 which extends upwardly from the surface 16. Each terminal has a wire-receiving slot 20 which is dimensioned to receive the conducting core 4 of one of the wires in the cable so that when the conductor is pressed into the slot, electrical contact with the conductor will be established between opposed edges of the slot. The wire-receiving portions 18 are arranged in side-by-side relationship in two offset parallel rows with the spacing between the wire-receiving slots 20 of adjacent terminals being equal to the nominal spacing d between adjacent conductors in the cable. All of the conductors in the cable can be connected to the terminals by locating the cable above the upper ends of the wire-receiving portions 18 with the conductors in alignment with the slots 20 and then moving the cable downwardly until it is adjacent to the surface 16. The upper ends of the wire-receiving portions of the terminals will penetrate the cable and the conductors will enter the slots 20, the insulation of the conductor being locally displaced during the process so that the edges of the slots will be in engagement with the conductors 4. The connector shown has a cover member 22 having depending arms 24 at its ends. These arms have suitable latching means for cooperation with complementary latching means on the housing 4 to hold the cover on the housing after the connector has been installed on the cable. As shown at 26, openings are provided in the cover member which receive the wire-receiving portions 18 of the terminals.

FIGS. 3–8 show a fixture of the type disclosed and claimed in my above identified U.S. Pat. No. 4,005,518 (Application Ser. No. 666,552). This fixture serves to locate the cable and the connector relative to each other with the conductors 4 in alignment with the wire-receiving portions 18 of the connector preparatory to installation of the connector on the cable. The fixture shown in the drawing has incorporated therein a wire positioning means in accordance with the invention. Some structural details of the fixture are described below to provide the necessary background information for the description presented hereinbelow of the principles of the instant invention.

The fixture 28 comprises a connector supporting means 32 and a cable supporting means 34. The connector supporting means has a base plate 36 which is provided with an elongated surface 38 (FIG. 4) upon which the face of the connector is supported. Locating bosses 42, 42′ project upwardly at the ends of the surface 38 and these locating blocks have laterally extending ears 44, 44′ which extend into portions of the cable supporting means 34 as described below.

The cable supporting means comprises a generally rectangular frame 46 having parallel side rails 48, 48′ connected to each other by end blocks 50, 50′. The opposed surfaces of the blocks 50, 50′ are recessed as shown at 54, (FIG. 4) and the ears 44, 44′ extend into these recesses so that the parts are retained in assembled relationship. Limited movement of the frame member 46 towards the connector support surface 38 is permitted by virtue of the fact that the recesses 54 are oversized relative to the thickness of the ears 44. The cable clamping means 34 is normally biased upwardly to the limit of its travel by springs 52, 52′ which extend into recesses in the opposed surfaces of the blocks 50, 50' and the surface of the base plate member 36.

Side rails 48, 48' have laterally outwardly extending flanges 56, 56' on their upper ends, the upper surfaces 58, 58' of these flanges constituting cable supporting surfaces when the connector is installed on a cable intermediate the ends thereof. Only the surface 58 is used as a cable supporting surface when the connector is installed on the end of the cable as will be explained below.

The cable supporting surfaces 58, 58' have flutes in accordance with the invention as specifically described below and the surfaces 73, 73' of clamping bars 72, 72' have similar surfaces which cooperate with the surfaces 58, 58' when the fixture is put to use to properly locate the conductors in the cable with the wire-receiving portions of the terminals. Opposed shoulders 60, 62 are provided on the ends of the surfaces 58, 58' so that the side edges of the cable can be located against these shoulders when the cable is placed in the fixture.

The end block 50' has an upwardly facing surface 64 (FIG. 4) which supports one of the flanges 17 of the connector housing. The other flange is supported on the upper surface of a transversely extending support plate 66 which extends across the gap between the side rails 48, 48'. Support plate 66 is L-shaped having an arm portion 68 which is received in a channel 70' in the side rail 48', the side edge of the plate portion 66 being received in a corresponding channel in the side rail 48. The supporting plate 66 and its integral arm portion 68 can thus be moved leftwardly as viewed in FIG. 5 towards the end block 50' so that a smaller size connector can be accommodated in the fixture and its flanges will be supported on the surface 64 and the surface of support plate 66. Advantageously, a locking means (not specifically shown) can be provided to lock the support plate 66 in any desired position in the slot 70'.

The cable is clamped by clamping bars 72, 72' which differ from each other in certain respects. The clamping bar 72 is used when a connector is being installed on the end of a cable and will be described first.

Figure 3:
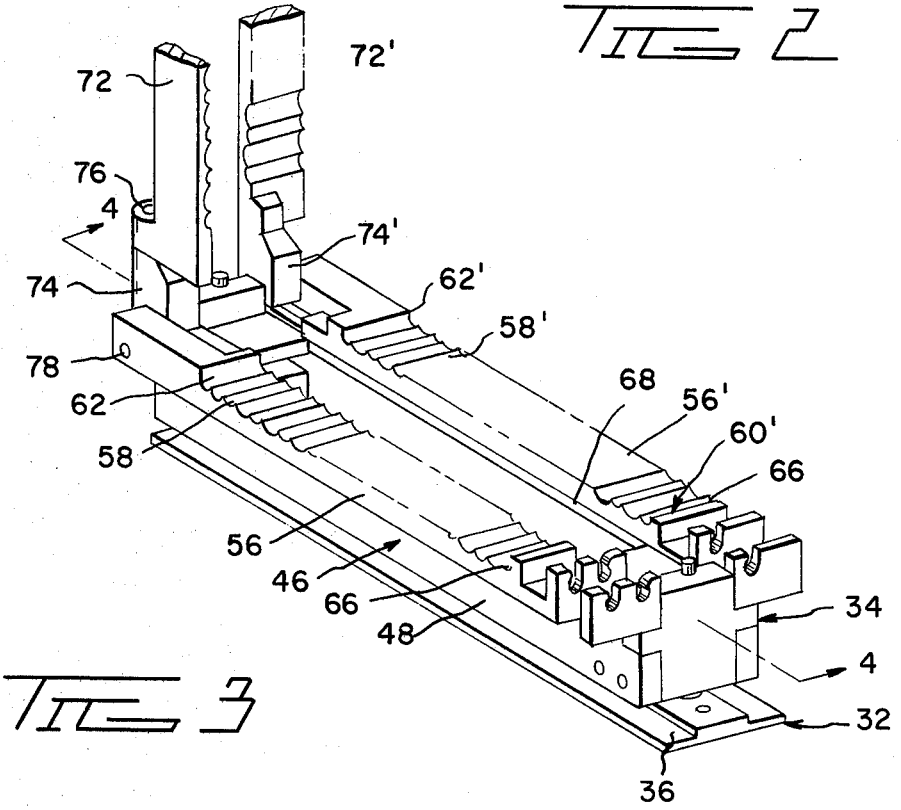
FIG. 3 is a perspective view of one form of fixture which is employed when the connector of FIG. 2 is installed on the cable of FIG. 1, this fixture having conductor aligning means in accordance with the invention for precisely aligning the conductors of the cable with the terminals of the connector.

Clamping bar 72 is pivotally mounted on two pivotal axes, one of which extends through the lefthand end of clamping bar 72 and through a pivot block 74 which is disposed on the left hand end as viewed in FIG. 3 of the side rail 48. This pivotal axis is defined by a pivot pin 76 which extends through the end of the clamping bar and the block 74, the axis of this pin being parallel to the length of the clamping bar. At its other end, a pivot pin 84 (FIG. 7) extends from the clamping bar 72 and is received in a notch 88 in an enlarged end portion of the side plate 50. It will be noted that clamping bar 72 is notched or cut away as shown at 80 along its side edge which extends beside the opening in the fixture which receives the connector, the width of this cut away portion being slightly greater than the width of the cable.

This first pivotal axis for the clamping bar 72 permits it to be rotated between the position shown in FIGS. 1 and 2. When it is in the position of FIG. 5, there is sufficient clearance to insert the cable into the notch 80 until its cut end 98 is against a stop surface 96. Thereafter, the clamping bar can be swung in the reverse direction to the position shown in FIG. 6 and the cable will be firmly clampled against the surface 58.

The pivot block 74 is pivotally connected to the end block 50' by a pivot pin 78 which extends through the flange 56, through the block 74, and into an upper central portion 73 of the end block 50'. By virtue of this pivotal mounting of clamping bar 72, it can be swung upwardly from the position of FIG. 5 to the position of FIG. 3 so that the cable, having a connector installed thereon, can be removed from the fixture.

Figure 5:
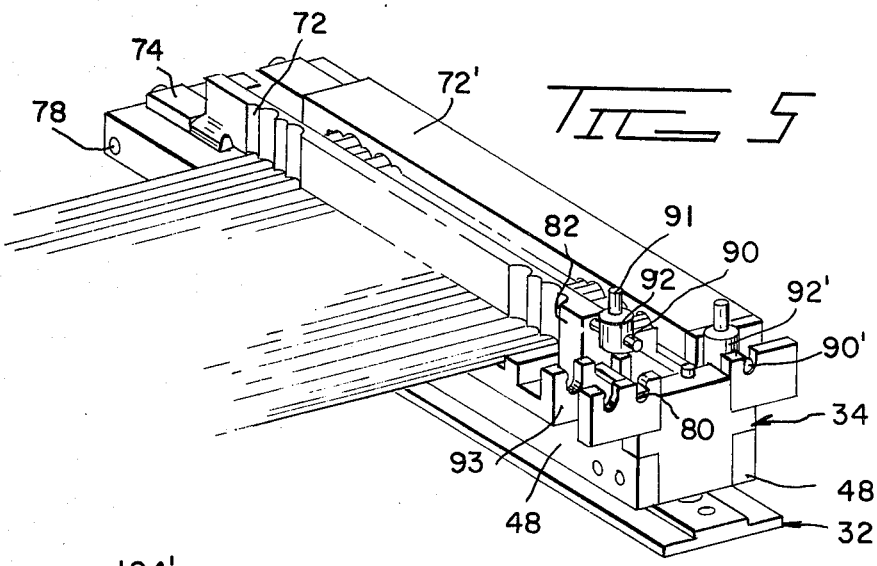
FIG. 5 is a perspective view of the fixture shown in FIG. 3 showing an end portion of the cable positioned in the fixture and showing the clamping bar 66 in its vertical orientation.
Figure 6:
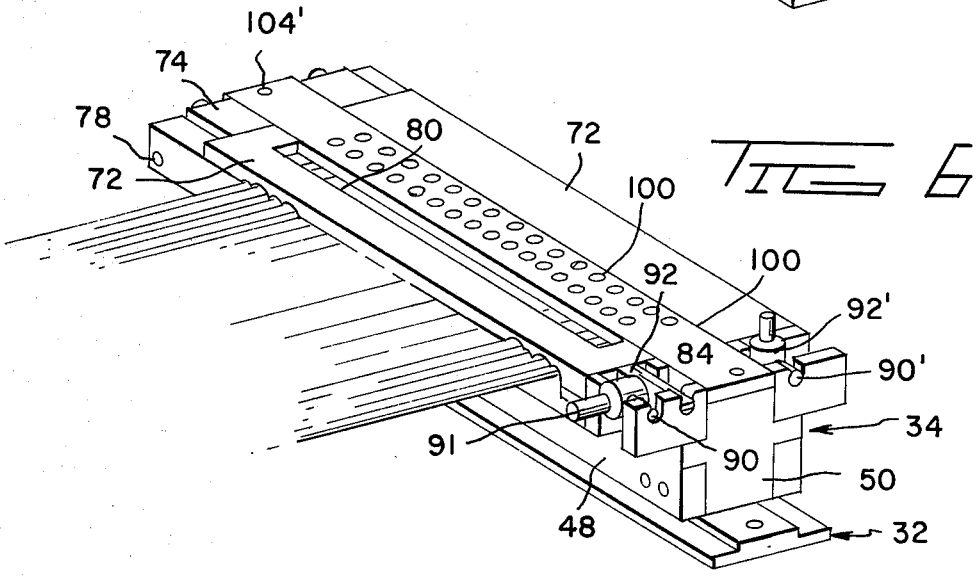
FIG. 6 is a view similiar to FIG. 5 but showing the clamping bar 66 in its closed position against the cable and showing pressure plate 94 positioned in the fixture.

The previously identified pivot pin 84 (FIG. 7) has flats ground on diametrically opposite sides and the slot or notch 86 is preferably a key hole-type slot having a constricted entrance so that the pin can enter the notch and can be rotated after it has fully entered the notch to permit shifting of the clamping bar between the positions of FIGS. 5 and 6.

The clamping bar 72 can be shifted between the positions of FIGS. 5 and 6 by means of a handle pin 91 having a bushing 92 thereon through which a pin 90 extends. A pin 90 extends into the end of the clamping bar as shown in FIG. 6 and a recess is provided for the bushing. The clamping bar is moved from the position of FIG. 5 to the position of FIG. 6 by simply swinging the pin 91 downwardly until the clamping bar is against the surface of the cable positioned on the cable supporting surface.

It will thus be apparent that it is merely necessary to grasp the pin 91 when the parts are in the position of FIG. 6 and swing it upwardly to permit insertion of the cable into the clearance between surface 58 and clamping bar 72. Pin 91 is then swung downwardly to clamp the cable and after the connector has been connected to the cable, pin 91 is again swung upwardly and the entire latch arm 72 is moved arcuately about its pivotal axis 78 away from the cable to permit removal of the connector (FIG. 3).

After the cable has been clamped in the fixture, a rectangular pressure plate 100 is located in the space between the adjacent edges of the clamping members 72, 72' on pins 104, 104' which extend from the end blocks 50, 50'. Pressure plate 100 has openings 102 extending therethrough to provide clearance for the upper ends of the terminals so that application of a force in the direction of the arrow of FIG. 6 results in downward movement of a pressure plate and the cable clamping means with respect to the connector on the connector supporting surface.

The geometry of the flutes in the opposed surfaces 58, 73 of the flange 56 and the clamping arm 72 is shown in FIG. 9. The surface 73 has side-by-side flutes 106, 108 which extend thereacross and which have a radius of curvature which is substantially greater than the diameter of the insulating material 6 as will be described more fully below. The flutes 106 are recessed into the surface 73 relatively more deeply than the flutes 108. The surface 58 has recessed flutes 112 which are opposed to the relatively shallow flutes 108 of the surface 73 and the surface 58 has relatively shallow flutes 114 which are opposed to the recessed flutes 106 of the surface 73. When the two surfaces are against each other as shown in FIG. 9, the geometric centers of the opposed pairs of flutes, as viewed in cross section, defines a zig-zag path as is apparent from FIG. 9.

The spacing between the center lines of adjacent pairs of flutes 106, 108 and 112, 114 is in the preferred embodiment equal to the nominal spacing $d$ between adjacent conductors 4 of the cable. This center-to-center spacing between adjacent centers is measured between the vertically extending center lines of the flutes as viewed in FIG. 9 rather than along the diagonal lines wich would connect the centers. It should be noted that the cavities defined by opposed pairs of flutes 106, 114 and 128, 112 communicate with adjacent cavities through constructed sections which are defined by round surfaces 110, 111. The web material 8 of the cable 2 is confined in these constructed sections when the cable is clamped between the surfaces as described below.

Figure 10:
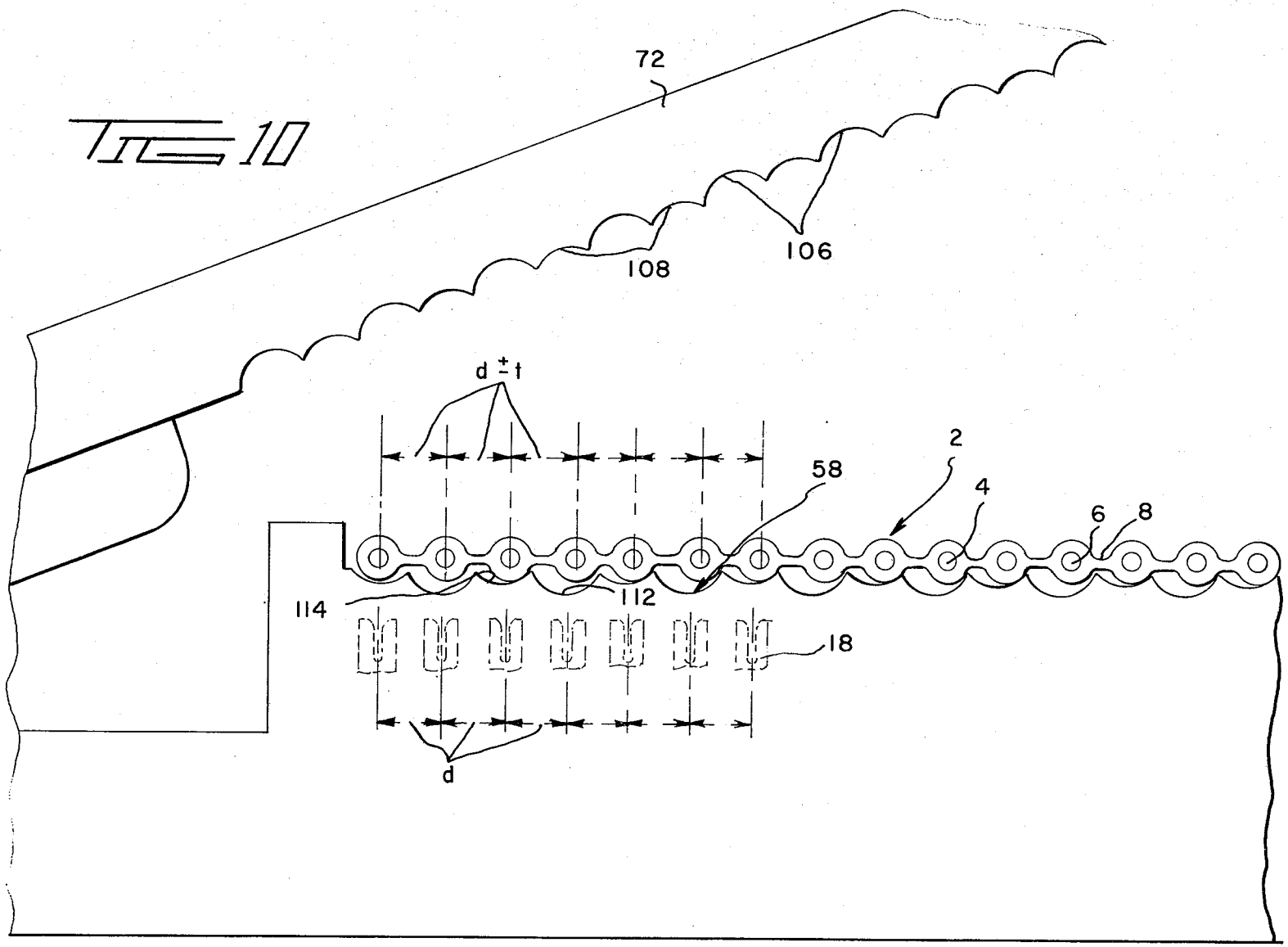
FIG. 10 is a semi-diagramatic view of the cable supporting surface and the clamping bar illustrating the manner of positioning the cable on the cable supporting surface in preparation for connector installation on the cable.
Figures 11, 13:
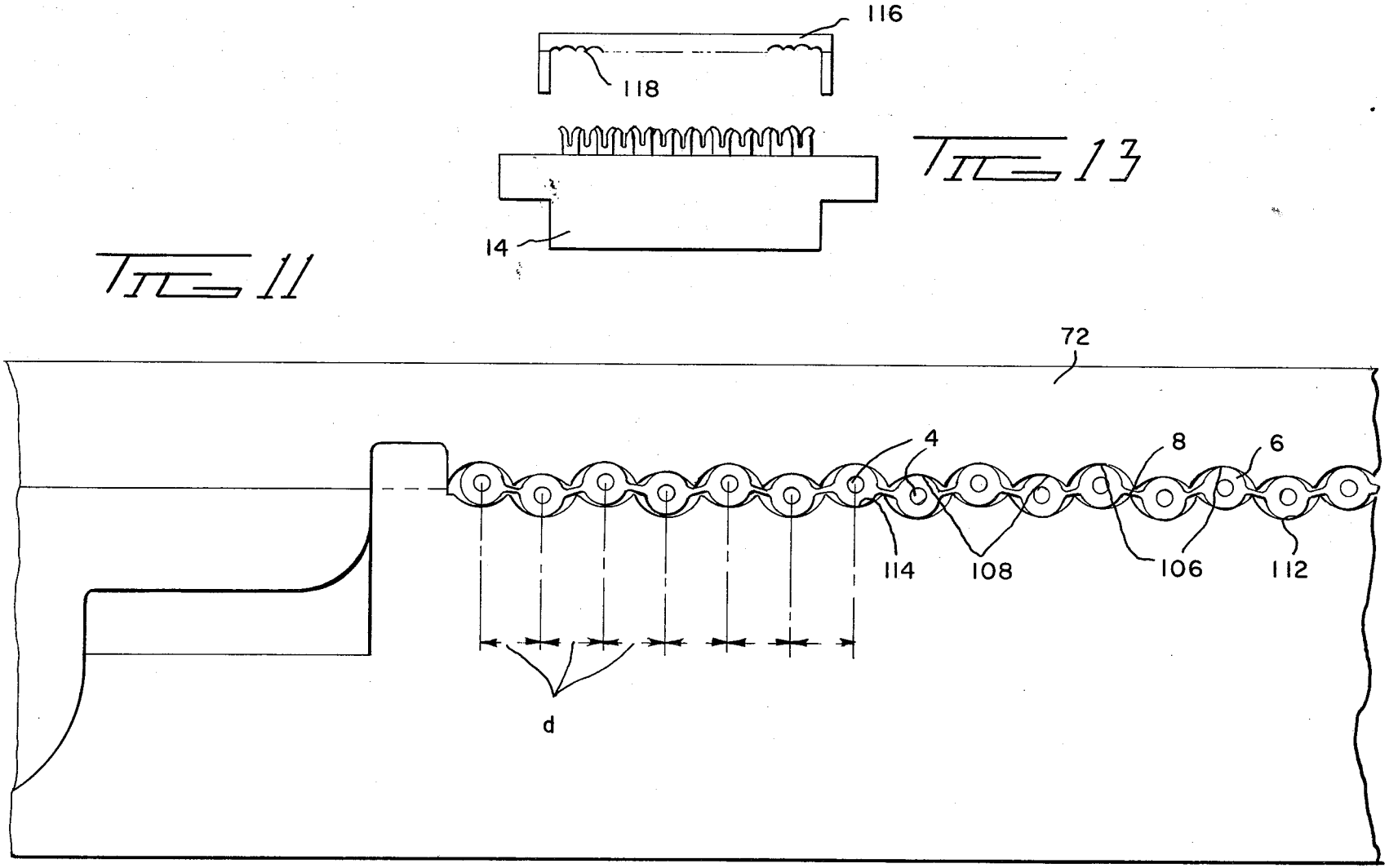
FIG. 11 is a view similiar to FIG. 10 but showing the clamping bar disposed against the cable supporting surface and illustrating the conductors of the cable after they have been properly positioned with respect to each other.
FIG. 13 is a frontal view of a connector having conductor positioning means in accordance with the invention.

FIGS. 10 and 11 illustrate the manner in which imperfectly or unevenly spaced conductors 4 in a cable 2 are repositioned in the fixture so that the conductors will be in alignment with the terminals in a connector mounted in the fixture. FIG. 10 shows a cable 2 which has several of its conductors offset from the positions they would occupy if the spacing between adjacent conductors were constant and uniform in the cable. It will particularly be noted that some of the conductors on the right hand portion of the cable are displaced so that they are offset from the center lines of the flutes in the surface 58 by significant distances. This view also shows the locations of the wire-receiving portions 18 of the terminals in the background and it will be noted that each terminal is precisely aligned with the center line of one of the flutes although the conductors in some instances are offset of the center lines of the wire-receiving portions 18.

Figure 4:
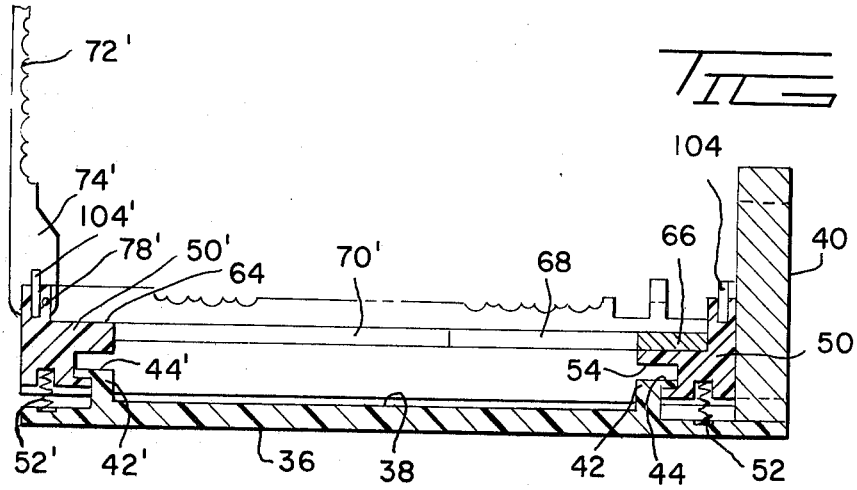
FIG. 4 is a view taken along the lines 4—4 of FIG. 3.

When a connector is being installed on the cable 2 the connector is first positioned in the fixture as shown in FIG. 4 and the cable 2 is positioned on the surface 58 as shown in FIG. 10. The arm 17 is then lowered from the position of FIG. 10 to the position of FIG. 11 and during such lowering of the arm 72, the opposed curved surfaces of the flutes will engage those conductors which are offset from their proper center lines and displace them laterally until they are properly centered or aligned with the wire-receiving portions of the terminals in the connector. While the conductors in the cable as shown in FIG. 11 follow a zig-zag pattern as viewed in cross section, the axes of the individual conductors are nonetheless in precise alignment with the slots 20 of the wire-receiving portions 18. When the conductors in the cable are repositioned as shown in FIG. 11 by the opposed surfaces 58, 73, the portions of the conductors which are adjacent to these surfaces and which are above the wire-receiving portions 18 of the terminals will also be repositioned and brought into alignment with the slots in the terminals. The operator can then complete the process of installing the connector on the cable by placing the pressure plate 100 in the fixture and applying a normal force against the pressure plate as illustrated by the arrow in FIG. 6.

When the connector is being installed on the end portion of the cable, the transverse edge at the end of the cable is located against the surface of the siderail 58' and the clamping bar 72' is not used. Preferably, the cable is placed on the surface 58 prior to lowering of the clamping bar 72 and the clamping bar 72 is lowered against the upwardly facing surface of the cable in order to realign or reposition the conductors progressively as the clamping bar moves to its lowered position as illustrated in FIGS. 10 and 11. It will be apparent that the clamping bar 72 must be rotated about the pivotal axis 76 prior to lowering so that the fluted surface 73 will be opposed to the fluted surface 58 during such arcuate downward movement of the clamping bar. Under some circumstances, the clamping bar 72 can be lowered to the position of FIG. 6 and the cable can be inserted through the space which is between the surfaces 58, 73 although this latter procedure may prove awkward, particularly if the cable has grossly misplaced conductors therein.

If the connector is being installed on an intermediate portion of the cable as shown in FIG. 8, the conductors of the cable are repositioned between opposed surfaces 58, 73 and by the opposed surfaces of the clamping bar 72' and the surface 58'. The flutes on the clamping bar 72' and the surface 58' are in alignment with the flutes on the opposed surfaces 58, 73 with recessed and shallow flutes being in registry.

The principles of the invention can be used on cables of any size and having the conductor center line spacing as required. However, some specific dimensions are presented below for an embodiment of the invention which is used and cable of the type shown in FIG. 1 having a conductor space of 0.050 inches and a tolerance range of ± 0.003 inches. Good results are obtained if the radii of curvature of all of the flutes 106, 108, 112, 114 is about 0.028 inches, in other words, slightly greater than $d/2$. The centers of curvature of the flutes 108 on the surface 73 are offset downwardly as viewed in FIG. 9 by a distance of 0.010 inches, about three times the tolerance limit $t$, relative to the center of curvature of the flutes 106. The flutes in the surface 58 are offset by the same amount, that is, the centers of curvature of the flutes 114 are offset upwardly by a distance of 0.010 inches from the centers of curvature of the flutes 112. It has been found that when these dimensions are provided on the surface 58, 73 the conductors 4 will be brought into alignment and repositioned on precise centers even if the spacing between adjacent conductors is as much as 0.060 inches or 0.040 inches; in other words, if the cable dimensions depart from the specifications by about three times the tolerance limits (± 0.003 inches) of the specification. If the nominal spacing between adjacent conductors is more or less than 0.050 inches, the dimensions and radii would be different from those discussed above but the same general relationships should be maintained.

FIG. 12 shows an alternative embodiment in which the centers of curvature of the flutes in each of the surfaces are offset by a substantially greater amount than that shown in FIG. 9. Specifically, the offset in FIG. 12 is such that when the surfaces 58, 73 are against each other, the diagonal line distance between adjacent center lines or the center lines of adjacent opposed pairs of flutes is 0.06 inches although the horizontal spacing remains at 0.050 inches between adjacent center lines. This embodiment is intended for use where the cable has a nominal spacing between adjacent conductors of 0.050 inches and the tolerance range is ± 0.010 inches. In practice, if the conductors are spaced-apart by as much as 0.070 inches or 0.030 inches, the conductors will be brought into alignment when the cable is clamped in the fixture.

It is emphasized that the dimensions given above by way of example can be departed from under some circumstances and they are not critical in the sense that a positioning means in accordance with the invention will be inoperative if the dimensions are not strictly adhered to. In the appended claims the centers of adjacent flutes are described as being offset by a distance which is equal to about $3t$ ($t$ being the limit of the tolerance range) and the radius of curvature of the flutes is set forth as about $d/2$. In fact, the radius of curvature of the flutes in the assemblies given above is slightly greater than $d/2$. Satisfactory results may sometimes be obtained if the dimensions are departed from but the effectiveness of a positioning means in accordance with the invention may be reduced.

As previously mentioned, the cable aligning means comprising opposed flutes in accordance with the invention can be used under a variety of circumstances and it is shown herein on the fixture illustrated only by way of example. The offset flute principle for aligning conductors can also be provided on a single surface and will serve to bring misaligned conductors into proper alignment. FIG. 13 shows a connector having a housing 14 and upstanding wire-receiving portions 18 of terminals as described previously. This connector has a cover member 116 having flutes 118 on its downwardly facing side, the flutes being relatively shallow and deep as described above. In accordance with this aspect of the invention, the cable is not placed in a fixture of the type shown in FIG. 5 but is simply located between the upper ends of the wire-receiving portions of the terminals and the downwardly facing surface of the cover 16 with the conductors in approximate alignment with the wire-receiving slots 20 of the terminals. When the cover member is assembled to the housing 14, any conductors which are not in proper alignment with the wire-receiving slots 20 will be laterally displaced between arcuate surfaces of the flutes until they are brought into proper alignment. The arcuate surfaces of the flutes cooperate with the enlarged entrance portions of the upper ends of the slots to being about such realignment of the conductors.

The fact that the conductors follow a zig-zag pattern when they are clamped in the positioning means enhances the grip of the clamping means on the cable and this is a distinct advantage, particularly where the flutes are provided on a connector as shown above.

What is claimed is:

1. A conductor positioning means which is intended for use with flat cable of the type comprising a plurality of parallel substantially co-planar conductors which are contained in continuous insulating material, said conductors being spaced-apart by a nominal spacing *d* said positioning means comprising:

a plate-like member having cable engaging surface which is entended to be positioned against said cable with said surface extending across said cable and transversely of the axes of said parallel conductors, side-by-side parallel flutes extending across said cable engaging surface, said flutes being spaced-apart on center lines which extend normally of said surface by said distance *d*, each of said flutes having a center of curvature and having a radius of curvature, said centers of curvature of alternate ones of said flutes being offset with respect to the centers of curvature of the remaining flutes, whereby upon pressing a section of said cable against said cable engaging surface, said insulating material will be distorted and said conductors will be positioned on said center-lines so that the said conductors assume a zig-zag pattern as viewed in cross section with the distance between adjacent conductors, as measured in the direction of the original plane of said cable, being said nominal spacing *d*.

2. A conductor positioning means which is intended for use with flat cable of the type comprising a plurality of parallel substantially co-planar conductors which are contained in continuous insulating material, said conductors being spaced-apart by a nominal spacing *d* and by an actual spacing which lies within the tolerance limits $d \pm t$, said positioning means comprising:

a plate-like member having cable engaging surface which is intended to be positioned against said cable with said surface extending across said cable and transversely of the axes of said parallel conductors, side-by-side parallel flutes extending in said cable engaging surface, said flutes being spaced-apart on center lines, which extend normally of said surface, by said distance *d*, each of said flutes having a center of curvature and having a radius of curvature, said radius of curvature being equal to about $d/2$, said centers of curvature of alternate ones of said flutes being offset with respect to the centers of curvature of the remaining flutes by a distance which is equal to about $3t$ whereby, upon pressing a section of said cable against said cable engaging surface, said insulating material will be distorted and said conductors will be positioned on said center-lines so that the said conductors assume a zig-zag pattern as viewed in cross section with the distance between adjacent conductors, as measured in the direction of the original plane of said cable, being said nominal spacing *d*.

3. A conductor positioning means as set forth in claim 2 in combination with a complementary conductor positioning means, said complementary conductor positioning means comprising a plate-like member having a complementary cable engaging surface, said complementary cable engaging surface having parallel flutes therein which are opposed to said parallel flutes in said cable engaging surface when said cable engaging surface and said complementary cable engaging surfaces are positioned against oppositely facing surfaces of said cable, said alternate and remaining flutes of said complementary cable engaging surface being interchanged with respect to said alernate and remaining flutes of said cable engaging surface.

4. A conductor positioning means and a complementary conductor positioning means as set forth in claim 3 in combination with a connector supporting means for supporting a multi-contact electrical connector of the type having contact terminals therein, said terminals having wire-receiving portions which are spaced-apart by said nominal spacing *d*, said connector supporting means being beside said conductor positioning means whereby conductors held in said conductor positioning means are held in alignment with said wire-receiving portions of said terminals.

5. A conductor positioning means as set forth in claim 2 in combination with a multi-contact electrical connector, said connector comprising a housing having a plurality of electrical contact terminals therein and having a cable-receiving surface, each of said terminals having a conductor-receiving portion, said conductor receiving portions extending normally from said cable-receiving surface, said conductor-receiving portions being spaced-apart by said distance *d*, said plate-like member constituting a cover for said housing and having openings extending therethrough for reception of said conductor-receiving portions of said terminals, and cooperating means on said housing and said plate-like member for securing said member against said cable receiving surface whereby, upon positioning said cable between said cable-receiving surface and said plate-like member with said conductors in approximate alignment with said conductor receiving portions and upon assembling said plate-like member to said housing, said conductors will be precisely positioned with respect to said conductor-receiving portions and inserted into said conductor receiving portions of said contact terminals.

6. Fixture means for holding a section of multi-conductor cable of the type comprising a plurality of parallel conductors lying in a single plane, said conductors being spaced-apart by a nominal spacing *d*, said fixture means comprising:

first and second clamping plates, said plates having first and second cable-engaging surfaces which are opposed to each other when said plates in assembled relationship, said surfaces having opposed aligned flutes therein, said flutes in each plate having center lines which are spaced-apart by said nominal spacing *d*, said flutes in each surface being alternatively relatively deep and relatively shallow, said relatively shallow flutes in said first surface being opposed to relatively deep flutes in said second surface and relatively deep flutes in said first surface being opposed to relatively shallow flutes in said second surface, each pair of opposed flutes having a common center as viewed in cross section which is mid-way between the opposed surfaces of said opposed flutes, said centers defining a zig-zag path as viewed in cross section with the distance between adjacent centers as measured in a direction parallel to said plates being substantially equal to *d* whereby, upon locating said section of said cable between said surfaces with said conductors in approximate alignment with said flutes and thereafter moving said plates towards each other until said section of said cable is clamped between said surfaces, said individual conductors and portions of the insulation which surrounds said indvidual conductors will be repositioned along said zig-zag path so that the spacing between adjacent conductors as measured in the original plane of said cable is *d*.

7. Fixture means as set forth in claim 6 having pivotal connecting means serving pivotally to connect said plates to each other at corresponding ends of said surfaces whereby said plates are moved towards each other along an arcuate path and the conductors in a cable positioned on one of said surfaces are progressively repositioned as said plates move towards each other.

8. In an apparatus for installing a multi-contact connector on a flat multi-conductor cable, said cable being of the type having a plurality of conductors in side-by-side spaced-apart relationship, said connector being of the type comprising an insulating housing having a cable receiving face and a plurality and contact terminals in said housing, said terminals having conductor receiving portions which extend from said cable receiving face, said apparatus comprising connector supporting means for supporting said connector, cable supporting means having a cable supporting surface which extends parallel to, and beside said cable supporting surface of said connector, said surfaces being offset from each other by a distance such that the free ends of said wire-receiving portions are approximate to the plane defined by said cable supporting surface, clamping means for clamping said cable against said cable supporting surface with a portion of said cable extending past said free ends of said wire-receiving portions, the improvement comprising:

side-by-side parallel flutes extending across said cable supporting surface and across the surface of said clamping means which is opposed to said cable supporting surface, said flutes being spaced-apart on center lines which extend normally of said cable supporting surface by the nominal spacing *d* between adjacent conductors in said cable, said flutes in each of said surfaces being alternatively relatively shallow and relatively deep so that the centers of opposed pairs of flutes as viewed in cross section define a zig-zag path whereby, upon positioning said cable on said cable support surface and clamping said cable against said surface by said clamping means, said cable is deformed along said zig-zag path transversely of its length and said conductors are positioned precisely in alignment with said free ends of said wire-receiving portions of said terminals, and upon downward movement of said cable, said conductors will be inserted into said wire-receiving portions.

9. Apparatus as set forth in claim 8, having an additional cable supporting surface and an additional clamping means, said connector supporting means being between said cable supporting means and said additional cable supporting means whereby portions of a cable intermediate the ends thereof can be positioned in said apparatus to align the conductors thereof with terminals in a connector on said connector supporting means.

* * * * *